US005901685A

United States Patent [19]

Noyce et al.

[11] Patent Number: 5,901,685

[45] Date of Patent: May 11, 1999

[54] FUEL INJECTOR WITH DAMPING MEANS

[75] Inventors: Stephen Anthony Noyce, Poole; Martin Paul Hardy, Gillingham, both of United Kingdom

[73] Assignee: Lucas Industries, United Kingdom

[21] Appl. No.: 09/110,826

[22] Filed: Jul. 6, 1998

[30] Foreign Application Priority Data

Jul. 12, 1997 [GB] United Kingdom ..... 9714647

[51] Int. Cl.[6] ..... F02M 37/04

[52] U.S. Cl. ..... 123/467; 123/496

[58] Field of Search ..... 123/446, 467, 123/500, 501, 496, 300, 299

[56] References Cited

U.S. PATENT DOCUMENTS

| | | | |
|---|---|---|---|
| 4,627,571 | 12/1986 | Kato | 123/467 |
| 4,684,067 | 8/1987 | Cotter | 123/467 |
| 4,798,186 | 1/1989 | Ganser | 123/467 |
| 4,805,580 | 2/1989 | Buisson | 123/467 |
| 5,012,786 | 5/1991 | Voss | 123/467 |
| 5,156,132 | 10/1992 | Iwanaga | 123/467 |
| 5,638,791 | 6/1997 | Tsuzuki | 123/467 |
| 5,664,545 | 9/1997 | Kato | 123/467 |
| 5,694,903 | 12/1997 | Ganser | 123/467 |
| 5,832,899 | 11/1998 | Soteriou | 123/467 |

*Primary Examiner*—Carl S. Miller
*Attorney, Agent, or Firm*—Michael, Best & Friedrich

[57] ABSTRACT

A fuel injector comprises a valve needle biased by a spring towards a seating. The spring engages a spring abutment member which is moveable with a piston member. The spring abutment member defines, with a member carried by the needle, a damping chamber which communicates through a restricted passage with a low pressure drain to damp movement of the needle relative to the piston member.

8 Claims, 1 Drawing Sheet

FUEL INJECTOR WITH DAMPING MEANS

INJECTOR

This invention relates to an injector for use in supplying fuel to a cylinder of an internal combustion engine. In particular, the invention relates to an injector of the type capable of supplying a pilot injection followed by a main injection.

FIG. 1 illustrates an injector of this type. The injector illustrated in FIG. 1 comprises a valve needle 10 biased into engagement with a seating by a spring 12. The spring 12 engages a spring abutment forming part of a piston member 14 slidable within a bore which communicates through a passage 16 with the pumping chamber 18 of a fuel pump 20. A valve member 22 is carried by the piston member 14 and is engageable with a seating to close the passage 16. The pumping chamber 18 communicates with the valve needle 10 through a passage 24 whereby fuel under pressure can be applied to the needle 10 to lift the needle 10 from its seating. A spill valve 26 also communicates with the passage 24.

In use, initially the spill valve 26 is open, thus operation of the pump displaces fuel from the pumping chamber 18 through the spill valve 26 to a low pressure drain. Subsequent closure of the spill valve allows the pump to pressurize the fuel within the pumping chamber 18 and passage 24 resulting in the fuel pressure applied to the needle 10 increasing. When the fuel pressure exceeds a certain level, the needle 10 lifts against the action of the spring 12 by a small distance allowing fuel to be delivered past the seating at a restricted rate, commencing a pilot injection. The delivery of fuel is at a relatively low rate, and the fuel pressure in the pumping chamber 18 and passage 24 continues to increase. When the fuel pressure exceeds a second predetermined level, the pressure acting on the valve member 22 is sufficient to lift the valve member 22 from its seating. The movement of the valve member 22 allows fuel to act over the whole end area of the piston member 14 resulting in the piston member 14 moving in a direction which compresses the spring 12, causing an interruption in the fuel pressure increase, and returning the valve needle 10 into engagement with its seating. It will be appreciated that the movement of the piston member 14 compresses the spring 12, thus a higher fuel pressure must be applied to the valve needle 10 to recommence injection. Subsequently, this pressure is reached and the main injection commences. To terminate injection, the spill valve 26 is opened resulting is a rapid fall in the fuel pressure applied to the needle 10, the spring 12 returning the needle 10 into engagement with its seating.

During the pilot injection, the needle 10 does not occupy its fully lifted position, its position being determined by the applied fuel pressure and the force exerted by the spring. In use, the fuel pressure applied to the needle may fluctuate from one injection to another, for example resulting from engine speed changes, changes in fuel viscosity, changes in metered fuel quantities or changes in the timing at which delivery is to occur. Such pressure variations result in variations in the injection characteristics, and in particular the quantity of fuel delivered during the pilot injection. Additionally, the momentum of the injector needle may result in the needle moving beyond its desired position during pilot injection, again resulting in changes in the quantity of fuel delivered during pilot injection.

It is an object of the invention to provide an injector in which the disadvantages described hereinbefore are reduced.

According to the present invention there is provided a fuel injector for use in a fuel system including a fuel pump and a spill valve, the injector comprising a fuel injection nozzle including a fuel pressure actuated valve needle which is lifted from a seating, in use, by the action of fuel under pressure in a nozzle inlet passage thereby to allow flow of fuel from the nozzle inlet passage through an outlet, said nozzle inlet passage communicating with a pumping chamber of the fuel pump, a spring biasing the valve needle towards the seating, a piston member slidable within a cylinder and acting as an abutment for the spring, a further passage opening into a first end of the cylinder remote from the spring, the further passage communicating with the pumping chamber, the piston member being moveable from a first position at the first end of the cylinder to a second position at the other end of the cylinder to increase the force exerted on the valve needle by the spring, valve means operable by the piston member to limit the end area of the piston member exposed to the fuel pressure in the further passage when the piston member occupies its first position, and damping means for damping movement of the valve needle relative to the piston member, wherein the damping means comprises a damping chamber of volume dependent upon the relative positions of the valve needle and the piston member, the damping chamber communicating through a restricted passage with a low pressure drain.

The presence of the restricted passage restricts the rate at which the volume of the damping chamber can change, hence restricting the rate at which the valve needle can move relative to the piston member, enabling more accurate control of the position of the valve needle thus reducing variations in injector performance across several injections.

The invention also relates to a fuel injection system comprising, in combination, a fuel pump, a spill valve, and an injector as defined hereinbefore. The injector and fuel pump may form a single unit.

The invention will further be described, by way of example, with reference to the accompanying drawings, in which.

Figure 2:
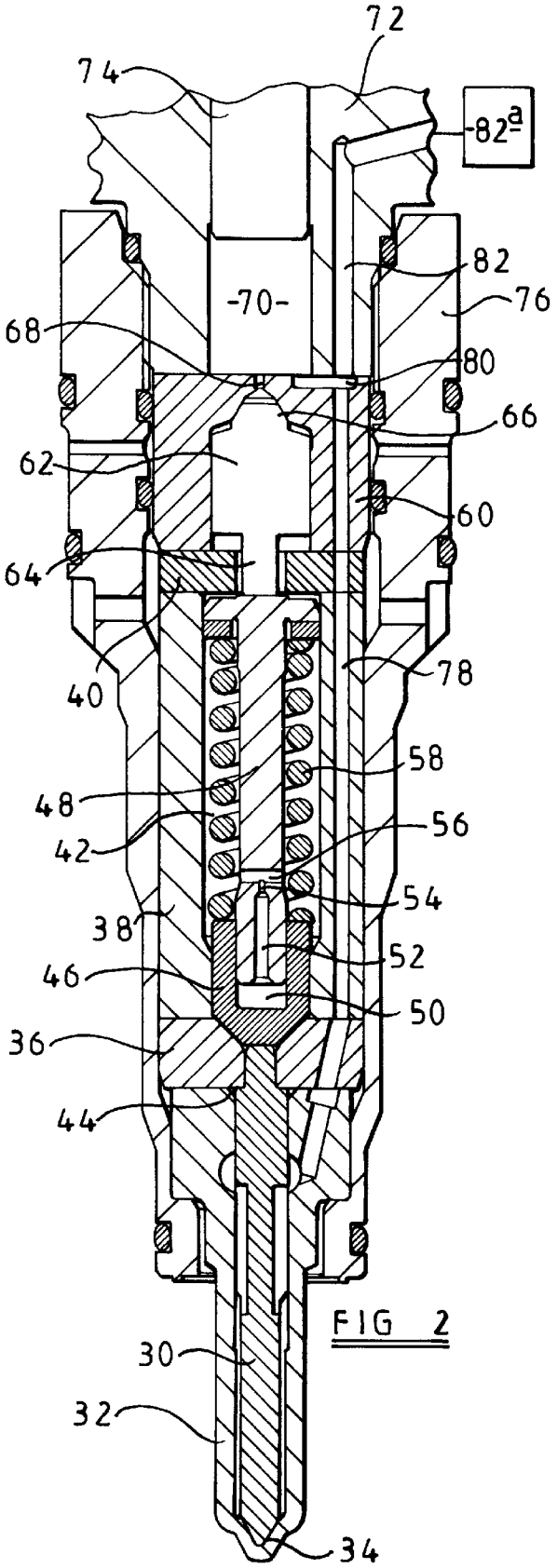
FIG. 2 is a sectional view of part of an injector constituting an embodiment of the invention.

FIG. 2 illustrates part of a pump injector arrangement which comprises a valve needle 30 slidable within a bore formed in a nozzle body 32. The bore of the nozzle body is a blind bore, and the blind end of the bore communicates with one or more small openings 34 whereby fuel is delivered to a cylinder of an associated engine. The valve needle 30 is engageable with a seating defined around a part of the bore to control the supply of fuel to the outlet openings 34. The nozzle body 32 abuts a first distance piece 36 which in turn abuts a spring housing 38 of tubular form. The spring housing 38 abuts a second distance piece 40, and as shown in FIG. 2, the first and second distance pieces 36, 40 and spring housing 38 together define a spring chamber 42 into which an end of the valve needle 30 extends. The spring chamber 42 communicates through a passage (not shown) with a low pressure drain. The valve needle 30 is shaped so as to include a shoulder 44 which is engageable with the first distance piece 36 in order to limit movement of the valve needle 30 away from its seating.

The end of the valve needle 30 remote from the seating engages a cup-shaped member 46 including a recess within which an end of a spring abutment member 48 is received. The spring abutment member 48 and cup-shaped member 46 together define a damping chamber 50. The spring abutment member 48 is provided with an axially extending passage 52 which includes a restricted region 54, the restricted region 54 in turn communicating with a diametrically extending passage 56 whereby the damping chamber 50 communicates with the spring chamber 42. A helical spring 58 is engaged between the spring abutment member 48 and the cup-shaped member 46 to apply a force to the valve member 30 to bias the valve member 30 towards its seating. The end of the spring abutment 48 is a sufficiently good fit within the cup-shaped member 46 that substantially no fluid can enter or escape from the damping chamber 50 other than through the passages 52, 56, although a small amount of leakage may be permitted, for example to aid lubrication.

The second distance piece 40 abuts a piston housing 60 including a cylinder within which a piston member 62 is slidable. The piston member 62 includes a projection 64 which extends through an opening provided in the second distance piece 40 and abuts an end of the spring abutment member 48. The dimensions and range of sliding movement of the piston member 62 are such that the spring abutment member 48 is prevented from contacting the second distance piece 40, thus the force due to the compression of the spring 58 is transmitted through the piston member 62 to the piston housing 60, the piston member 62 acting, in effect, as an abutment for the spring 58.

The end of the piston member 62 remote from the projection 64 is shaped to define a valve member 66 which is engageable with a seating defined around a passage 68 which openings into a pumping chamber 70 to be described hereinafter.

The end face of the piston housing 60 remote from the second distance piece 40 abuts a pump housing 72 having a bore provided therein, part of which defines the pumping chamber 70. A pumping plunger 74 is reciprocable within the bore under the action of a cam arrangement (not shown), a return spring being provided to withdraw the plunger 74 from the bore between compression cycles of the pump. The nozzle body 32, first distance piece 36, spring housing 38, second distance piece 40 and piston housing 60 are secured to the pump housing 72 by means of a cap nut 76 which is in screw-threaded engagement with the pump housing 72.

Figure 1:
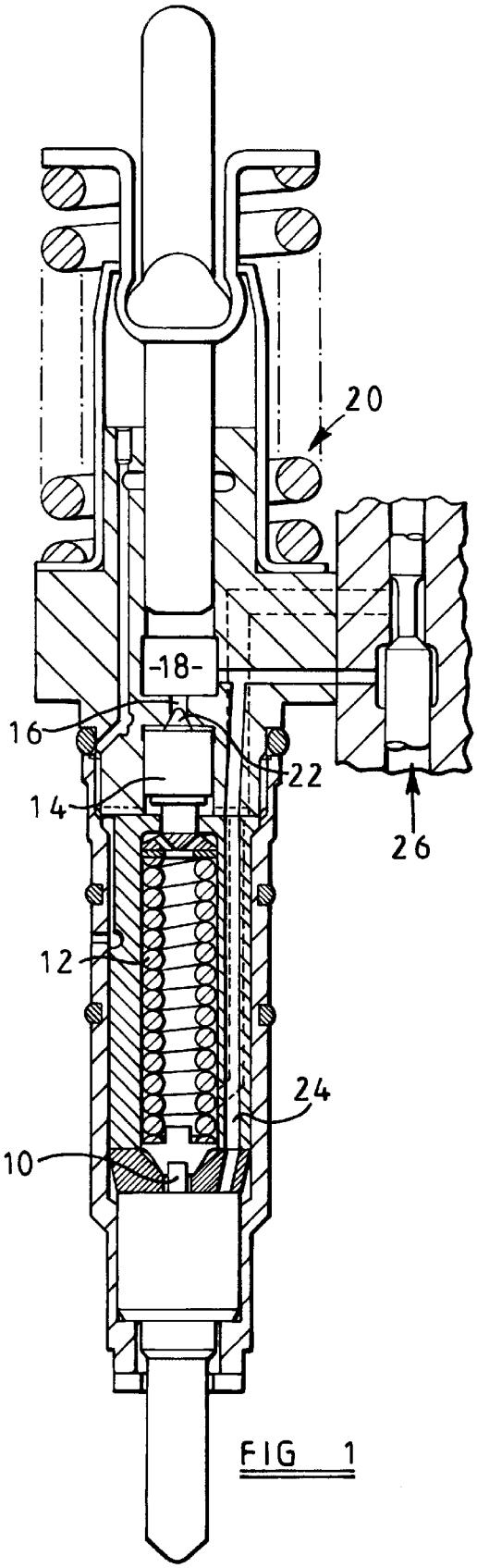
FIG. 1 is a sectional view illustrating a known injector.

A nozzle supply passage 78 is provided through each of the first and second distance pieces 36, 40, the spring housing 38, and the piston housing 60, the nozzle supply passage 78 communicating with an annular gallery provided in the bore of the nozzle body 32, the annular gallery communicating via flutes provided in the valve needle 30 with the end of the bore defining the seating. The nozzle supply passage 78 communicates with a recess 80 provided in an end face of the piston housing 60, the recess 80 communicating with the pumping chamber 70. The recess 80 also communicates with a passage 82 which is connected to a spill valve 82*a,* the spill valve controlling communication between the passage 82 and the low pressure drain. The spill valve 82*a* may, for example, be of a form similar to that illustrated in FIG. 1.

In use, in the position shown, the plunger 74 occupies an outer position, and the pumping chamber 70 is at relatively low pressure. The spill valve is open, thus the pumping chamber 70 communicates with the low pressure drain. The spring 58 biases the valve member 66 of the piston 62 into engagement with its seating, and biases the valve needle 30 into engagement with its seating. From this position, inward movement of the plunger 74 results in fuel from the pumping chamber 70 being displaced through the spill valve to the low pressure drain. Any pressure increase within the pumping chamber 70 due to the inward movement of the plunger 74 is insufficient to cause movement of the piston member 62 or the valve needle 30.

In order to commence injection the spill valve is closed and continued inward movement of the plunger 74 compresses the fuel within the pumping chamber 70 and nozzle supply passage 78. As the fuel pressure increases, so the force acting on the valve needle 30 tending to lift the valve needle 30 from its seating also increases as a result of the high pressure fuel acting on angled surfaces of the valve needle 30. The force acting on the valve needle 30 rises to a level at which it is able to overcome the force of the spring 58, thus the valve needle 30 commences movement away from its seating, and a pilot injection of fuel commences.

The movement of the valve needle 30 away from its seating causes the cup-shaped member 46 to move relative to the spring abutment member 48 reducing the volume of the damping chamber 50. As fuel can only escape from the damping chamber 50 through the passages 52, 56 and the restricted region 54, the rate at which the valve needle 30 can lift from its seating is limited. The damping chamber 50 and restricted region 54 act, in effect, as a hydraulic spring of high stiffness and with no prestressing. It will be appreciated, therefore, that as the rate at which the valve needle 30 lifts from its seating is relatively low, the movement of the valve needle 30 is more controlled than in the known arrangement, and in particular the disadvantage of the prior art arrangement of the momentum of the valve needle causing the needle to move beyond a desired position during pilot injection is reduced.

During the pilot injection, the needle 30 occupies a position which is dependent upon the force applied by the spring 58 and the pressure applied to the needle 30. The rate at which fuel is delivered is relatively low, and the continued movement of the plunger 74 results in the pressure within the pumping chamber 70 continuing to rise. The fuel pressure rises to a level at which the force applied to the piston member 62 as a result of the action of the high pressure fuel on the exposed part of the valve member 66 is sufficient to cause movement of the piston member 62 permitting fuel to flow through the passage 68 into the piston cylinder. The flow of fuel to the cylinder reduces the pressure applied to the valve needle 30, thus there is a reduction in the magnitude of the force lifting the valve needle from its seating. In addition, the high pressure fuel is able to act over all of the end surface of the piston member 62 resulting in the application of a high force to the piston member 62 sufficient to overcome the reduced force lifting the valve needle 30 from its seating. The valve needle 30 thus returns to its seating, terminating the pilot injection. The presence of the damping chamber 50 and restricted region 54 increases the downward force applied to the needle at this stage by transmitting the force applied to the piston member 62 through the fuel within the damping chamber 50 as well as compressing the spring 58.

After the termination of the pilot injection, the continued action of the high pressure fuel on the piston member 62 results in the piston member 62 moving to compress the spring 58 until the piston member engages the second distance piece 40, thus requiring the application of a greater force to the valve needle 30 to permit the needle 30 to lift from its seating. The presence of the damping chamber 50 and restricted region 54 will damp the movement of the piston member, thus permitting increased control over the separation of the pilot injection from a subsequent main injection. As injection is not taking place at this stage of the injection cycle, and as the plunger continues to move inwardly, the fuel pressure applied to the needle 30 continues to rise, and a point will be reached beyond which the fuel pressure is sufficient to cause the valve needle 30 to lift against the action of the spring 58 to commence a main injection of fuel. Again, the movement of the needle 30 is damped by the damping chamber 50 and restricted region 54, but as during this part of the injection cycle, the valve needle 30 will lift to its fully open position in which the shoulder 44 engages the first distance piece 36, such damping is less effective than that occurring during the pilot injection.

In order to terminate injection, the spill valve is opened resulting in a rapid drop in the pressure applied to the needle 30. The reduction in pressure allows the valve needle 30 to move into engagement with its seating under the action of the spring 58. The spring 58 also returns the piston member 62 to the position illustrated in which the valve member 66 engages its seating. It will be appreciated that such movement of the valve needle 30 and piston member 62 requires fuel to flow into the damping chamber 50.

The spill valve remains open whilst the plunger 74 completes its inward movement, displacing fuel from the pumping chamber 70 to the low pressure drain, and during the subsequent retraction of the plunger under the action of its return spring, whereon fuel is drawn through the spill valve to charge the pumping chamber 70 with fuel ready for commencement of the next injection cycle.

Although, in the description hereinbefore, the damping chamber 50 communicates with the spring chamber 42 and low pressure drain reservoir through the restricted region 54, it will be appreciated that such communication could be achieved by way of a controlled clearance between the member 46 and the lower end of the abutment 48, or by providing one or more grooves or slots in the member 46 or abutment 48 rather than by way of the passage 52 and restricted region 54.

Alternatively, a restricted drilling may be provided in the member 46 to permit fuel to escape from the chamber 50 to the spring chamber or, for example, to the volume defined between the member 46 and the first distance piece 36.

In a further alternative, the member 46 may include a rod-like extension which extends upwardly into a bore provided in the piston member 62, the damping chamber being defined between the piston member 62 and the extension, and communicating through small diameter drillings provided in the extension with the spring chamber.

Although the description hereinbefore is of a pump injector arrangement, it will be appreciated that the invention may also be applied to fuel systems in which the fuel pump is physically separated from the injector, appropriate high pressure fuel supply lines being used to supply fuel from the pump to the injector.

We claim:

1. A fuel injector for use in a fuel system including a fuel pump and a spill valve, the injector comprising a fuel injection nozzle including a fuel pressure actuated valve needle which is lifted from a seating, in use, by the action of fuel under pressure in a nozzle inlet passage thereby to allow flow of fuel from the nozzle inlet passage through an outlet, said nozzle inlet passage communicating with a pumping chamber of the fuel pump, a spring biasing the valve needle towards the seating, a piston member slidable within a cylinder and acting as an abutment for the spring, a further passage opening into a first end of the cylinder remote from the spring, the further passage communicating with the pumping chamber, the piston member being moveable from a first position at the first end of the cylinder to a second position at the other end of the cylinder to increase the force exerted on the valve needle by the spring, valve means operable by the piston member to limit the end area of the piston member exposed to the fuel pressure in the further passage when the piston member occupies its first position, and damping means for damping movement of the valve needle relative to the piston member, wherein the damping means comprises a damping chamber of volume dependent upon the relative positions of the valve needle and the piston member, the damping chamber communicating through a restricted passage with a low pressure drain.

2. A fuel injector as claimed in claim 1, wherein the valve means forms part of the piston member.

3. A fuel injector as claimed in claim 1, further comprising a spring abutment member arranged to engage the piston member to transmit the load of the spring to the piston member, wherein the damping chamber is defined between the spring abutment member and a member moveable with the valve needle.

4. A fuel injector as claimed in claim 3, wherein the restricted passage is provided in the spring abutment member and provides a restricted flow path between the damping chamber and a spring chamber within which the spring is located.

5. A fuel system comprising a fuel pump, a spill valve and a fuel injector as claimed in claim 1.

6. A fuel system as claimed in claim 5, wherein the fuel pump and the fuel injector form a single unit.

7. A fuel system as claimed in claim 6, wherein the spill valve is mounted upon the fuel pump.

8. A fuel system as claimed in claim 5, wherein the fuel pump and the fuel injector are physically separated from one another, a high pressure fuel line being provided to carry fuel from the pump to the injector.

* * * * *